US006590758B1

(12) United States Patent
Friede et al.

(10) Patent No.: US 6,590,758 B1
(45) Date of Patent: Jul. 8, 2003

(54) WAKEUP AND SAFETY CIRCUITS

(76) Inventors: John Friede, 237 N. Parker St., Walcott, IA (US) 52773-8567; Dan Boddicker, 1052 195th St., Tipton, IA (US) 52772-9421; Mitchell P. Schmalz, 108 Oberlin St., Iowa City, IA (US) 52245

( * ) Notice: Subject to any disclaimer, the term of this patent is extended or adjusted under 35 U.S.C. 154(b) by 210 days.

(21) Appl. No.: 09/681,497

(22) Filed: Apr. 17, 2001

(51) Int. Cl.[7] ..... H01H 47/00

(52) U.S. Cl. ..... 361/170; 713/320; 713/323; 340/3.4; 340/10.33

(58) Field of Search ..... 361/170, 100, 361/18; 370/311; 340/3.4, 10.33; 713/323, 321, 324, 320, 322, 340; 700/297

(56) References Cited

U.S. PATENT DOCUMENTS 4,665,350 A * 5/1987 Angi et al. ..... 318/254
4,965,550 A * 10/1990 Wroblewski ..... 340/524
5,216,674 A 6/1993 Peter et al.
5,402,257 A 3/1995 Hasselmann et al.
5,418,679 A 5/1995 Crane et al.
5,552,641 A * 9/1996 Fischer et al. ..... 307/10.5
6,115,831 A 9/2000 Hanf et al.

* cited by examiner

*Primary Examiner*—Brian Sircus
*Assistant Examiner*—Isabel Rodriguez
(74) *Attorney, Agent, or Firm*—James C. Nemmers

(57) ABSTRACT

A wakeup circuit is disclosed that allows for provision of a circuit completing ground connection in response to actuation of a control for a networked accessory such that a resting system may draw zero current when not in use and respond upon actuation through the powering of a central control module and networked accessories. A safety circuit is also disclosed for removing power from networked accessories in the event communication with a central control module is lost. A combination circuit is disclosed wherein the safety circuit is integral with the wakeup circuit to provide a circuit appropriate for use in a system of networked accessories wherein energy conservation is a priority and improved safety in the form of improved power termination reliability is desired.

22 Claims, 6 Drawing Sheets

WAKEUP AND SAFETY CIRCUITS

BACKGROUND OF INVENTION

There exists a need in many applications for a wakeup circuit to allow the remote initiation of power and control to a "dormant" accessory of a system without demanding from the user a separate step of system power initiation. There exists a further need to provide such a circuit that may operate without demanding a current draw associated with leaving the "dormant" system or accessory in a state of powered readiness or in a state of reduced power usage wherein a small current draw is maintained. There also exists a need in many applications for a safety circuit that is designed to provide a method for terminating the supply of power to the system or system accessories in the event that a microprocessor or other control unit fails, or in the event that a microprocessor or control unit loses contact with a remote accessory.

In passenger vehicles and especially in motor homes, luxury coaches, and recreational vehicles, the typical patterns of use involve periods of driving separated by extended periods of parked or stationary usage or extended periods of storage. In such vehicles, it is common for there to exist a large number of electrically powered or assisted accessories ranging from cooking amenities such as microwave ovens and refrigerators, to basic utilities such as lights, to entertainment equipment such as stereos and televisions, to starter engines for generators, etc. Further, it has become popular to provide powered, extendable or expandable rooms in such vehicles. Also, there have been introduced various power-controlled doors, steps and other slideable or extendible panels. Extendible rooms, for example, typically comprise a frame that is moveable between a retracted position, wherein a wall of the frame serves as an outer wall of the coach, to an extended position wherein the frame extends outwardly from the outer wall of the coach to serve as a sitting space, storage space, or other area convenient and appropriate for the chosen application. Numerous other power-controlled amenities or features are common including leveling systems or jacks to stabilize the vehicle when parked, and slide-out mechanical bays that provide easy access for maintenance and repairs.

In recreational vehicles, as in passenger vehicles, it is known to provide, through a separate power control panel, or more commonly through the ignition switch, a means for providing power to only select systems or subsystems within the vehicle. This practice is commonplace in passenger vehicles and light trucks wherein the radio, power windows, and other accessories may be provided with power by turning the ignition switch to an "accessory" (or other appropriately named) setting that does not provide power, for example, to the starter engine, alarms, or other various non-selected systems. In this fashion, it is possible to have vehicle accessory systems that do not draw a current when they are not in use. However, as previously noted, it is necessary to supply power to these systems before they are placed in a state of readiness for use. Further, it is necessary to group these systems for shared use of a dedicated power switch or it is necessary to provide a plurality of power switches for the selected items.

In recreational vehicles which are commonly viewed as luxury items and which, of course, serve as homes for snowbirds, travelers, and professionals who must tour on a regular basis, it is desirable to provide maximum convenience. Given the size and the nature of use of such vehicles, operation of accessories frequently is desired when the operator is located remotely from the driver's seat, for example, in the rear of the vehicle interior, at other spaces in the vehicle interior, or at locations on the exterior of the vehicle (if, for example, powered doors, or slide-out mechanical bays are accessed from the vehicle exterior). There is therefore a need to provide for convenient operation of accessories from the remote location. Given the length of periods during which such vehicles are parked or stored, there is also a need to conserve energy to prevent batteries from becoming drained. Therefore, the need to provide for convenient operation of accessories from a remote location is complicated by the need to provide a system that draws little or no current when in a dormant or waiting state.

The prior art includes various wakeup circuits wherein a system is provided with a standby or sleep mode in addition to a normal operating mode. An example from the area of vehicle systems is U.S. Pat. No. 5,216,674. As disclosed in the '674 patent, it is known to provide a Controlled Area Network (CAN) circuit system in vehicle systems. In general terms, a CAN system or interface system connects via bus lines the numerous components, subsystems, and systems that form the substations of the CAN. CAN systems typically employ two communication lines for the movement of signals between a central control module and remotely distributed input/output modules. The '674 patent discloses a particular wakeup circuit for a CAN vehicle system having a low power usage or low current draw sleep mode. Specifically, the wakeup circuit of the '674 patent is described as having been designed to be operable even in the event that one of the two signal lines fails due to short circuit to ground or due to disturbance in voltage supply. However, at all times a fault detection current draw is present in the circuit of the '674 patent.

In addition to the need for wakeup functionality, there also exists a need for an improved safety circuit designed to remove power to networked accessories in the event that the central control module or microprocessor fails or loses contact with an accessory. In many applications, for example, in the case of slide-out rooms in recreational vehicles or coaches, it is beneficial to provide as a safety feature a means for suspending power supplied to the slide out-room if power failure, communication failure, or microprocessor failure occurs. Therefore, the presently described invention includes circuits having wakeup functionality and circuits having safety or power suspension functionality. Although described with reference to vehicle-based application, it will be understood by those of ordinary skill in the art that the present invention is widely applicable beyond the field of vehicles and in many systems. The invention is of particular value in systems wherein energy conservation and/or safety-based power termination are important design considerations. Examples of applications for such systems are legion as the present invention relates broadly to the provision of the cited functionality.

SUMMARY OF INVENTION

The present invention relates generally to a wakeup circuit that allows remote initiation of power and control to a "dormant" accessory or system without demanding that system power be initiated in a separate step. The present invention also relates to a wakeup circuit that does not demand a quiescent or latent current draw by the system when in its dormant state. The present invention relates also to a safety circuit and to a safety circuit in combination with the wakeup circuit. The exemplary embodiment described herein relates specifically to a CAN type accessory or module system. However, the invention relates generally to other networked applications or network protocols and is not dependent upon the use of a CAN protocol.

In the wakeup circuit for providing power and control to a system accessory when that system accessory lies in a dormant state that may be characterized by zero current draw, a switch is provided at an operator's panel or control panel for an accessory. Actuation of the accessory control switch provides a ground or reference voltage that, in effect, applies a ground "signal" to a wakeup wire. This ground connection is provided to a central control module ("CCM") and the voltage difference exposed to the CCM from a power source and the ground causes current to flow to the CCM and "wake-up" the CCM. In turn, the networked accessories on the CAN system are powered in response to system power initiation through the CCM. From the user's perspective, however, the accessory may respond and be powered merely by actuation of the control switch or mechanism. To accommodate the remotely activated "waking up" of the CAN network, a "wakeup" wire, a controller power wire, and a controller ground wire are provided in a system trunk line in addition to the normal bus signal lines of the CAN system (typically comprising two shielded signal lines for communicating digital data and a "drain" line or wire).

When the control or switch is released, the ground "signal" is not detected by the CCM. After a determined amount of time without ground signal detection, the CCM automatically powers down the system and the dormant state is resumed. In this manner, without a ground available in the quiescent circuit to drive current from the higher voltage power source, the system may lie in a dormant state that draws no current. If desired, or if appropriate for a selected application, a quiescent current draw may be allowed by circuit design. For example, an output driver or other element may be disposed to remain exposed to a current draw when the system is in a dormant state. Therefore, although it is an object of the present invention to provide a wakeup circuit for use with a system having a zero current draw dormant state, it is understood that the present invention also encompasses those circuits that permit a small quiescent draw due to slight variations or deviation from the circuit described herein.

The safety circuit, which is described herein in combination with the wakeup circuit, and separately, comprises an AC source, preferably a first and a second operational amplifier, having output current feeds provided to opposite sides of a non-polarized capacitor and an AC relay coil arranged in series. In a state of normal operation, the safety circuit amplifier produces an AC current from an intermittent DC source. Because the capacitor will only pass AC current, catastrophic failure by the microprocessor, or other event that terminates exposure of the first operational amplifier to the DC source will also terminate the AC current across the AC control relay 30. Therefore, the capacitor appears to the system to be an open circuit and the coil of the AC control relay 30, which allows a normally open relay contact used to supply output drivers and the CAN bus modules, falls open terminating power to output drivers and causing other contacts to fall open and terminate power to the microprocessor. Generally therefore, the safety circuit comprises an input, an AC source, and a capacitor in series with an electrically operated, AC sensitive switch.

DETAILED DESCRIPTION

First Embodiment

Figure 1A:
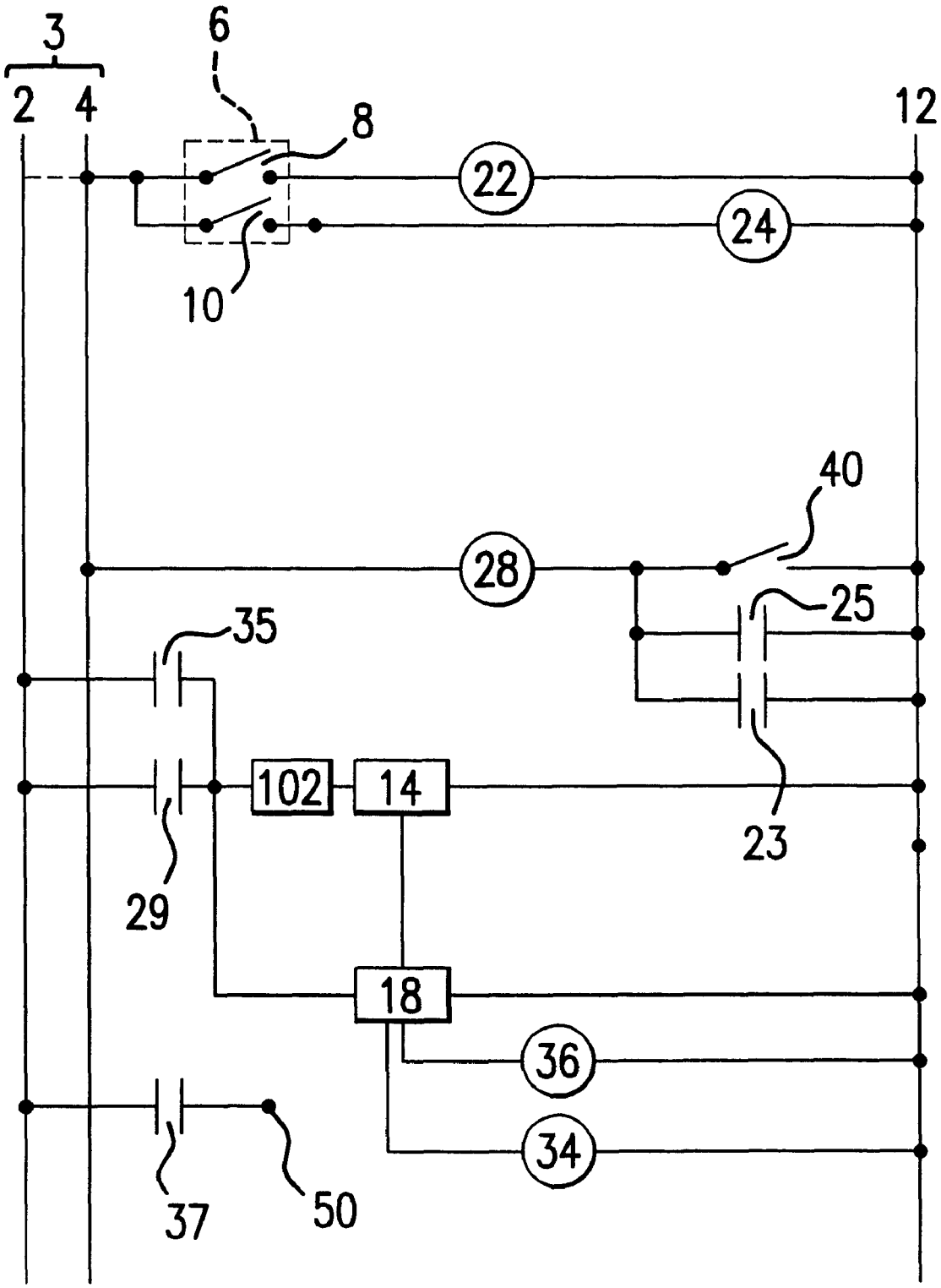
FIG. 1*a* is a circuit diagram of the first embodiment wakeup circuit illustrating a condition wherein quiescent current draw is zero.

Referring first to FIG. 1*a*, a possible embodiment of the present invention is provided as a wakeup circuit having a ground 12 (not necessarily a true ground) and a voltage source 3, preferably comprising a first voltage source 2 and a second voltage source 4 such as a house battery 2 and an engine battery 4. An operator's ignition switch or actuator (the term switch as used herein is not intended to be limiting in description but rather it refers to any actuator having alternate states such as opened or closed, first path, second path, etc.) is provided that may include an ignition switch power feed 8 from the engine battery 4 and an accessory switch power feed 10 from the engine battery 4. When the operator's ignition switch 6 is actuated, the ignition switch power feed 8 and/or accessory switch power feed 10 are closed. An ignition power sense electrically controlled switch 22, 23 is provided. It is preferred that this wakeup control relay 28, 29, and other electrically controlled switches described herein comprise control relays having coils and magnetically operative contacts. However any switches for example—solid state switches such as transistors, FETs, or other appropriate devices that provide a switching function responsive to a current may be used. For the purpose of describing the preferred embodiment, the specific example of a control relay is frequently used herein. The ignition power sense control relay 22, 23 comprising a relay coil 22 and normally open relay contact 23 are illustrated in FIG. 1*a*. Similarly, an accessory power sense control relay 24, 25 comprising an accessory power sense relay coil 24 and an accessory power sense relay normally open relay contact 25 is provided. The flow of current through the ignition and/or accessory power relay coils 22, 24 generates a magnetic field that causes the normally open relay contacts associated respectively therewith 23, 25 to close, thus providing a ground to the coil or controller 28 of a wakeup control relay 28, 29 having a wakeup normally open relay contact 29. Although not shown in proximate arrangement in FIG. 1, it will be understood by those of skill in the art that the ignition power sense relay 22 and 23, like other control relays or other switches described herein, is necessarily illustrated as separate parts, separately located. This diagrammatic convention is used for convenience in the 2-dimensional rendering of the present circuit and is not intended to be limiting in the description of the invention or of the preferred embodiment thereof, or in the relative positions of the paired electrically controlled switch elements such as relay coils and contacts.

Closure of the ignition and accessory power normally open relay contacts 23, 25 provides a connection to ground 12 and allows the wakeup circuit control relay coil 28 to receive current from the engine battery 4, preferably a 12V potential. The wakeup circuit control (relay coil) 28 switches the wakeup circuit normally open relay contact 29 to a closed state, thus powering the microprocessor via the house battery 2. It is preferred to employ a voltage regulator 102 before the microprocessor to expose the microprocessor to a 5V rather than a 12V potential. Of course, microprocessor selection will dictate voltage selection and the present invention is not intended to be limited in its scope to a particular voltage source, regulated voltage level, or regulator location.

Because the present embodiment is described with reference to a vehicle wherein it is preferred to employ a house battery 2 and an engine battery 4, the ignition 8 and accessory 10 switches are illustrated and described above to present general principles of operation. However, the wakeup circuit is not limited in its application to systems that employ separate ignition or accessory power connection means. Therefore, if the entire ignition and accessory actuators and electrically controlled switch assemblies are eliminated from FIG. 1*a*, the wakeup circuit may still be illustrated as described below. In the absence of closure of the ignition switch 6, or in the entire absence of the ignition switch assembly, power to the microprocessor may be provided by actuation of one of the separate wakeup switches or user controllable actuators 40. The wakeup switches 40, discussed further below, are preferably located throughout the vehicle interior and/or exterior at locations on or convenient to the accessory to be powered and operated.

When the logic control device 14, for example a microprocessor, is powered through exposure to a voltage-regulated 5V potential from the 12V source, the microprocessor provides a "weak" signal to the output driver 18 that, in turn, exposes the control (e.g., coils) 34 of a microprocessor latch control relay 34, 35 and the control 36 of a CAN bus power feed control relay 36, 37 to a larger potential and provides current through the contacts or coils 34, 36 sufficient to switch the associated contacts 35, 37 closed from their normally open positions. When the normally open relay contact 35 of the microprocessor latch control relay 35, 36 and CAN bus power feed relay 37 are closed, bridges are established between the microprocessor (via the voltage regulator 102) and the house battery 2, and between the CAN accessories and the house battery 2 (power to the networked accessories on the CAN bus system is provided via the bus control power line 50 illustrated as a part of the trunk line 100 shown in detail in FIG. 4). In this manner, the house battery 2 power is available to the networked accessories and the microprocessor when the wakeup switch is released, ground is disconnected from the wakeup circuit control relay coils, and the wakeup circuit control relay normally open contact 29 drops open and cuts off the initial path for house battery 4 power to the microprocessor 14. As is apparent from review of the Figures provided herein, a single power source or voltage potential source may suffice to provide the potential necessary for the present invention. Although the term microprocessor is used herein, any logic control device or combination of devices may be employed. Selection will necessarily depend upon computational capacity requirements, space requirements, and cost.

Therefore, through any wakeup switch 40 or the ignition 8 or accessory 10 switch, the microprocessor is powered-up through exposure to a voltage potential through a first path that is created through an electrically controlled switch 28, 29. The microprocessor is maintained in powered supply from a voltage source by a second path 35, 36. Preferably, the microprocessor 14 is programmed to power the system down by terminating current flow to the microprocessor latch control relay coil 34 and the CAN bus power feed control relay coil 36 (thus opening the microprocessor latch relay normally open contact 35 and the CAN bus power feed normally open relay contact 37) if all wakeup switches 40 and the ignition switch 6 have been off for a desired period of time, e.g. 10 minutes. This automatic powering down of the system is an additional energy conservation feature that may optionally be included in embodiments of the present invention. In the preferred powering down program, a 10 minute timer is started when the wakeup, ignition, or accessory switches are released. If the timer is interrupted by actuation of one of the switches, the timer is reset. Any convenient timing algorithm, or no timer at all, may be used depending on the application.

Figure 1B:
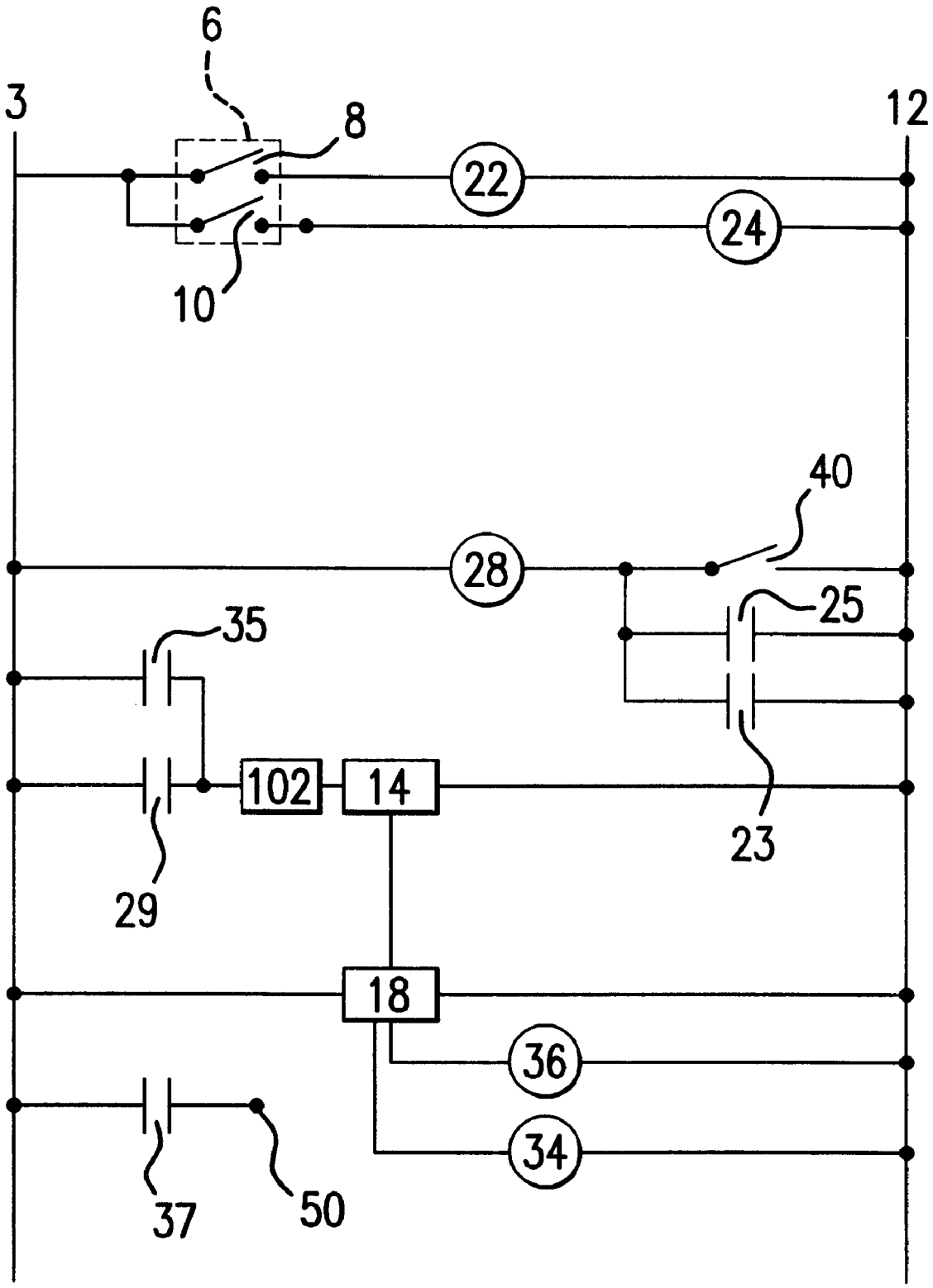
FIG. 1*b* is a circuit diagram of the wakeup circuit illustrating a condition wherein quiescent current draw may exist.

In reference next to FIG. 1*b*, a single potential source embodiment is provided having an output driver 18 coupled to a power source 3—even in a quiescent state. In this embodiment, the microprocessor power-on function and CAN system accessory power-on function are both wakeup or ignition switch initiated as described above. However, a quiescent current flow may exist through the output driver. An alternative embodiment may employ a single voltage source in the configuration shown in FIG. 1*a*.

Figure 2:
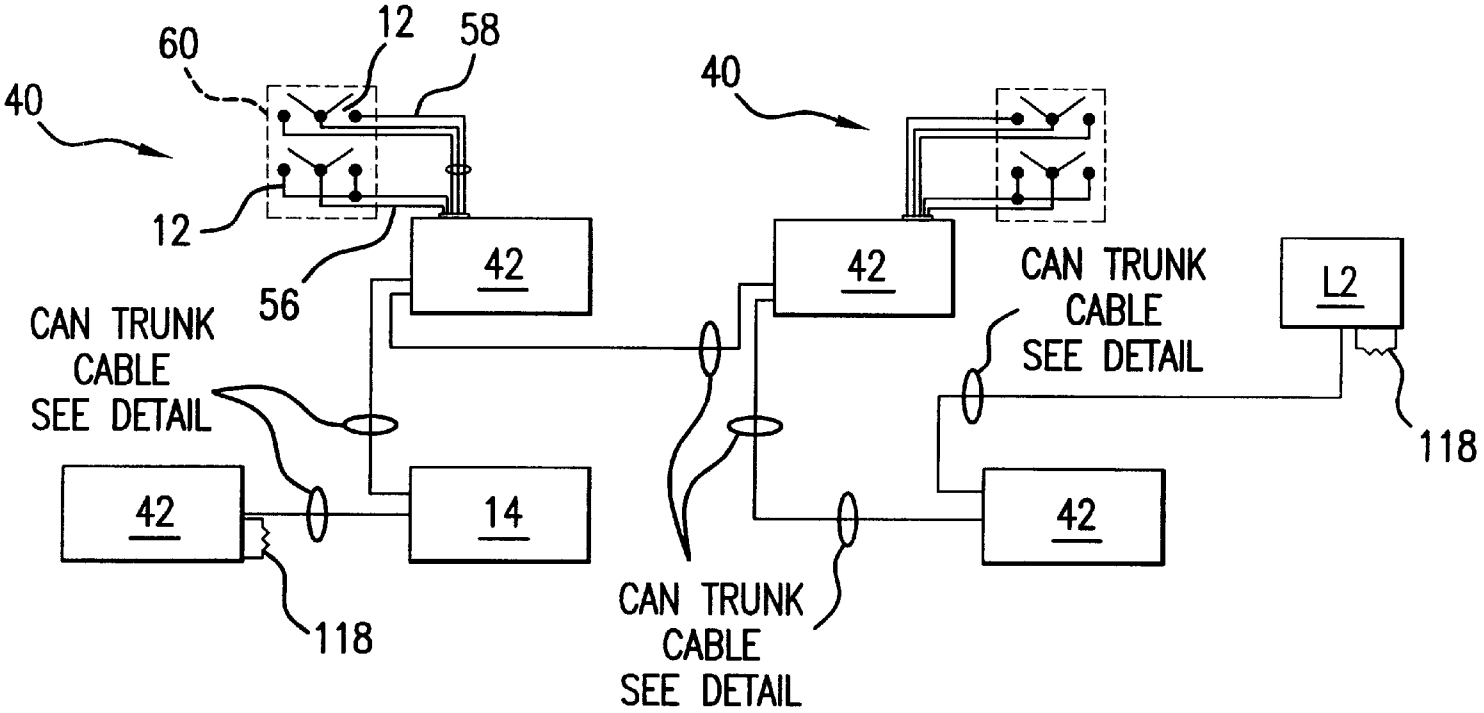
FIG. 2 is a block diagram of the wakeup circuit in a CAN system in accordance with the present invention in an application setting.
Figure 4:
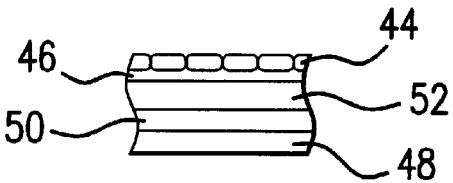
FIG. 4 is a cross sectional view of the multiple line wakeup circuit trunk line.
Figure 3:
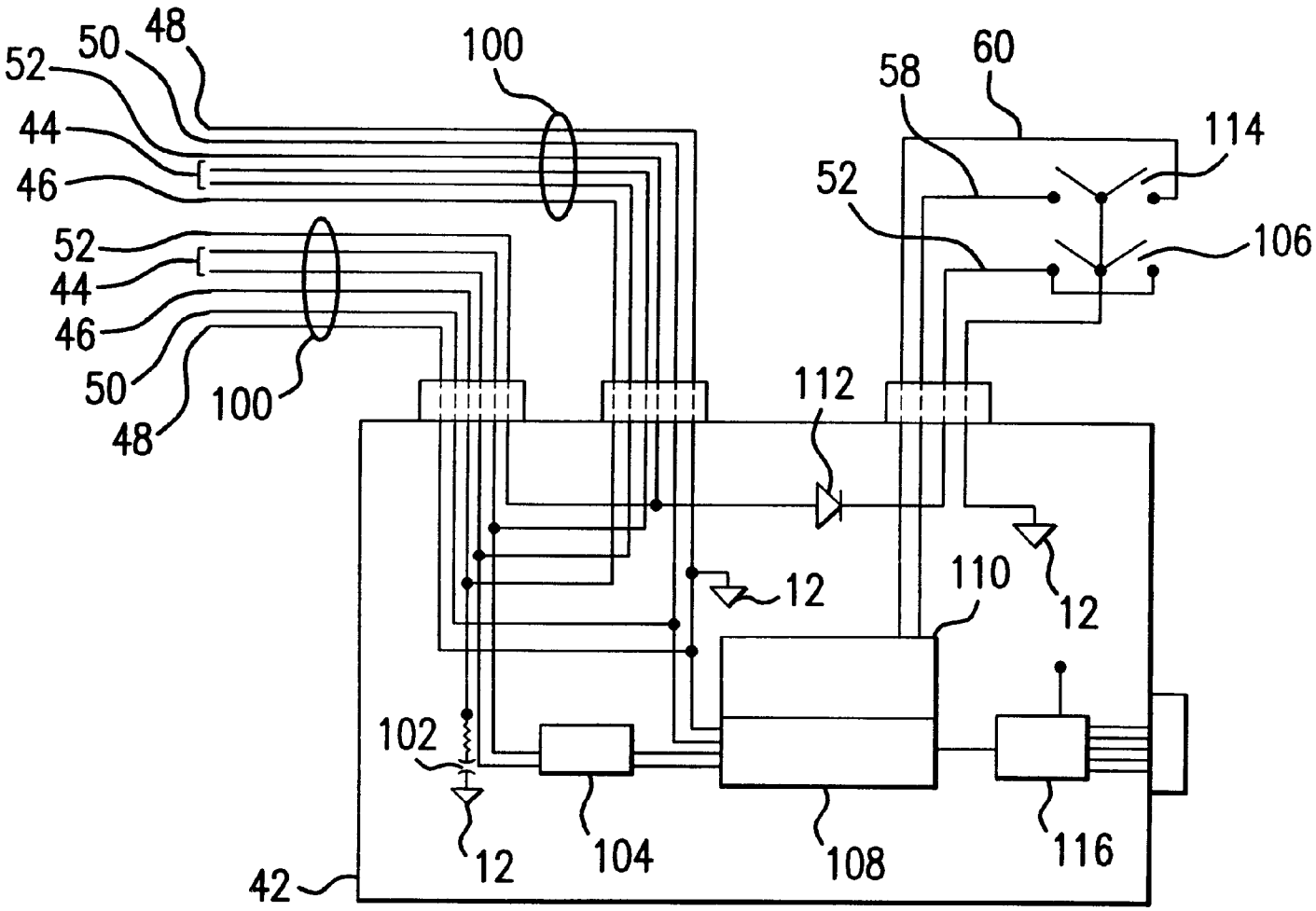
FIG. 3 is a detailed circuit diagram of an input/output module.

In reference next to FIGS. 2, 3, and 4, a block diagram is provided to illustrate a network system illustrated as a CAN system—with wakeup switches 40 and remote input/output modules 42. Also provided is a block diagram of the input/output module 42 and a detailed illustration of the CAN trunk cable 100. The CAN trunk cable preferably includes a typical CAN two line shielded pair 44 with a drain wire 46 as per SAE standard J1939. These two lines 44 are used to transmit data between the logic control device 14 (microprocessor, central control module or CCM) and the input/output modules 42. The drain wire 46, as per SAEJ1939 is grounded at the central control module. At other modules, the drain wire 46 is connected to a ground in series with a 1Ω resistor 120 and a 0.6 $\mu$F capacitor 122 pair. The drain wire 46 provides an electrical ground for the shield of the twisted pair, thereby minimizing EMI. In addition to these communication lines 42, a controller ground 48, controller power 50, and wakeup line 52 are provided in the CAN trunk cable 100. The controller power line 50 receives current through the closed-state CAN bus power feed relay 37 illustrated in FIGS. 1*a* and 1*b*. The controller ground line 48 is preferably connected with the ground reference 12 illustrated in FIG. 1. The wakeup line 52 is open unless grounded at a wakeup switch 40 in which case the wakeup line 52 serves as a ground reference 12 for the wakeup circuit as described.

In FIG. 2, the wakeup switches or user controllable actuators 40 are illustrated in their preferred embodiments as double pole throw switches. Operation of the selected switch, lever, button, etc. at any operator's panel provides a connection between a wakeup line 52 and a ground reference 12 and between an accessory first function option 58, 60. Additional switches may be provided (for example, the user-interface for the wakeup ground-connecting switch may be separated from the operation switch if desired). However, with a single switch in operation depression of the control switch 40 at the appropriate operator's panel provides a ground 12 to the wakeup line 52 (i.e. closes the wakeup switch 40 illustrated in FIG. 1) and provides power (if the associated networked accessory is an extendable room) to either a retract or extend control line 58, 60. When ground 12 is provided to the room extend or retract line 60, 58 the associated input/output control module 42 sends and receives signals to the CAN controller microprocessor and provides the appropriately polarized power to the accessory, for example to an output driver to actuate a solenoid valve to effect the desired extension or retraction of a hydraulic cylinder room drive.

FIG. 3 illustrates an input/output module ("IOM") in relation to the above-described double pole, double throw switch 40 and the CAN trunk line 100. The trunk line 100 (comprising component lines 44, 46, 48, 50, 52) enters the module 42. The input wakeup line 52 is connected to an exit wakeup line and, via a diode 112, to the ground-providing wakeup switch 40. The input CAN signal line pair 44 is connected to the output CAN signal line pair 44 and to an IOM microprocessor 108 via a CAN transceiver 104. The ground line 48 of the input CAN trunk line is connected to the ground line of output CAN trunk line, to a ground in the IOM, and to the IOM microprocessor 108. Similarly, the power line 50 of the input CAN trunk line is connected to the power line of output CAN trunk line and to the IOM microprocessor 108. From the switch 40, the wakeup pole 106 is connected via the diode to the trunk wakeup line 52. The operation or function control pole is connected via sensing circuitry 110 to the microprocessor 108. A ground is provided at the switch 40. Finally, output drivers 116 are provided to signal appropriate control devices (solenoid valves, electromechanical switches for drive mechanisms, etc.) in response to signals received from the CCM via the CAN transceiver and IOM microprocessor. Depending on the network selected and the protocol used, the local logic control 108 (such as an IOM microprocessor) and the central logic control 14, may have varied or distributed functions in accessory control and signal processing.

Of course, the present invention relates generally to the application of the wakeup system. The particular application described herein, with reference to a hydraulic drive system, solenoid valves, extendible rooms, and recreational vehicles is provided by means of example. It will be apparent to those of ordinary skill in the art that numerous applications may be made of the present invention. Application may be especially desirable in any setting where power conservation is a critical design parameter.

In recreational vehicles, it is important to provide a leveling system so that the parked RV may be placed in a horizontal and stable position regardless of terrain at the parking site. Such leveling systems require more control than a mere extend and retract function. Further, for safety purposes it is preferred to provide an ignition switch lock-out or dependency for such functionality. Therefore, although the system is, in general displayed as a centrally controlled network having control signals sent from the CCM or microprocessor 14, it is also known and preferred to provide more remote processing means at a select PIM 62 for selected accessories. As illustrated, the CAN trunk line 100, including the signal lines 44, drain 46, power 50, ground 48, and wakeup 52 lines still provides information and power to the PIM 62, just as with the IOMs 42. However, the PIM is typically located on a dash or driver's seat panel and in the field of vehicle leveling systems, it is preferred to direct leveling controls directly from output drivers associated with the central control unit.

Finally, in FIG. 2 terminal ends of the signal lines are unpaired and routed through one hundred and twenty ohm resistors 118 on the IOMs. These resistors 118 maintain the characteristic impedance on the line that is preferably a one hundred and twenty ohm cable. Also, a separate potential source, e.g. a 12V source may be provided to supplement power to select output drivers as needed. Such separate sources are preferably tied in to the wakeup functionality through electrically controlled switches.

Second Embodiment

Figure 5:
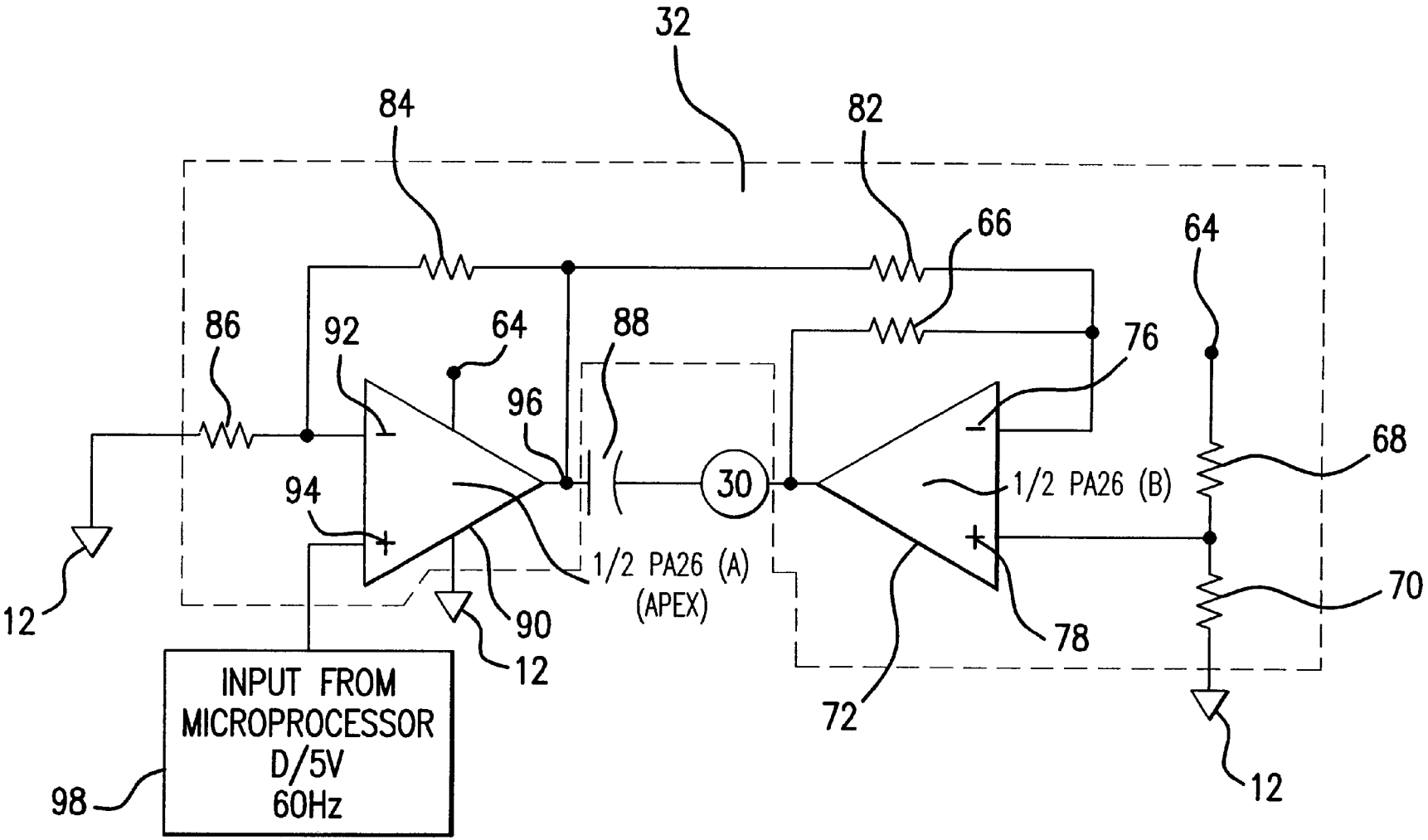
FIG. 5 is a circuit diagram of the second embodiment of the safety circuit.
Figure 6:
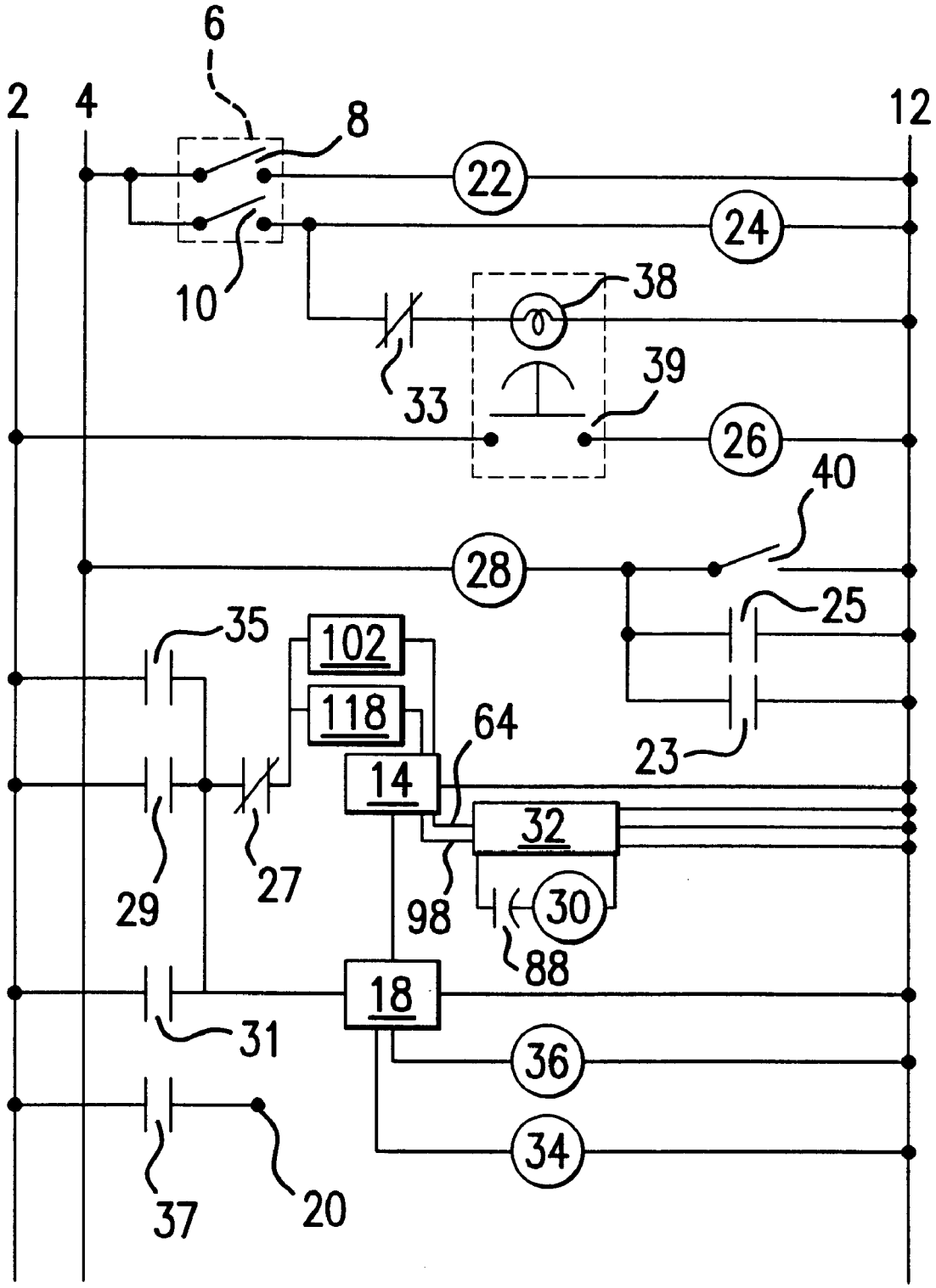
FIG. 6 is a circuit diagram of the third embodiment including the wakeup and safety circuit functionality.

FIG. 5 illustrates a safety circuit that is described herein in detail. FIG. 6 illustrates the safety circuit in combination with the wakeup system of FIG. 1. In the systems illustrated, the microprocessor or CCM 14 controls external loads or accessories (via the trunk line 100 that extends from 20) through a series of driver chips or output drivers 18. In the event of a CCM 14 failure, the safety circuit 32 is designed to drop out and kill the power source to the driver chips 18 as illustrated by the safety circuit normally open relay contact 31.

With specific reference to FIG. 5, a preferred safety circuit is illustrated having three connections to ground 12 a supply of a 7V DC potential 64 (preferably provided through a 12V–7V voltage regulator 118 positioned between the relay contacts 29, 35 and the microprocessor 14 (as illustrated in FIG. 6) and an input intermittent DC 0/5V at 60 Hz 98. The input intermittent DC 98 is received at the non-inverting input terminal 94 of a 1/2 PA26 dual power operational amplifier (overall 90 hereinafter "Op. Amp. A"). The 7V DC potential 64 is exposed to Op. Amp. A 90 and a separate lead is exposed to a ground reference 12. The inverting input terminal 92 of Op. Amp. A 90 leads through a first resistor 86, at 12 kΩ, to a ground reference 12. This inverting input terminal 92 also leads through a second resistor 84, at 5 kΩ, to the Op. Amp. A output terminal 96. From the Op. Amp. A output terminal 96, there exists, in series, a 1000 $\mu$F capacitor 88 and the coils of a safety circuit control relay 30 (or other control element of an electrically controlled switch whether electromechanical or solid state). A separate line from the Op. Amp. A output terminal 96 leads through a third resistor 82, at 10 kΩ, to the inverting input terminal 76 of a second 1/2 PA26 dual power operational amplifier (overall 72 hereinafter "Op. Amp. B"). From the third resistor 82 and the inverting input terminal of Op. Amp. B. 76 there also extends a fourth resistor 66, at 10 kΩ, to connection at the Op. Amp. B output terminal 78 and safety circuit control relay coil 30. The lead into the Op. Amp. B non-inverting input terminal extends from a point of imaginary ground exposing Op. Amp. B to a 3.5V DC potential. From this imaginary 3.5V DC "ground" a fifth resistor 68, at 10 kΩ, connects in series to the 7V DC potential source, and the imaginary 3.5V DC "ground" connects through a sixth resistor 70, at 10 kΩ resistance to the ground reference 12.

In operation, therefore, the microprocessor or otherwise controlled source provides a 0/5V 60 Hz square wave 98 or other intermittent DC source to Op. Amp. A 90. This gain circuit is set up so that Op. Amp. B 72 is a unity gain inverter driven from the output of Op. Amp. A 90. The net result is an AC source 32—an AC square wave is generated between Op. Amps. A 90 and B 72 which alternates about a reference point set at mid-supply by the fifth and sixth resistors 68, 70. The safety circuit AC control relay coil 30 is a 6V AC relay coil in series with the non-polarized 1000 $\mu$F capacitor 88.

Because a capacitor will not pass DC current, and because any failure by the source of the 0/5V at 60 Hz results in the input to Op. Amp. A 90 being at a continuous DC voltage level, no current flows through the safety circuit AC control relay coils 30 and the safety circuit control relay contact reverts to is normal state (illustrated as applied in the wakeup circuit of FIG. 6 as a normally open contact at 31 and a normally closed contact at 33). In general, an intermittent DC source 98 causes an AC source 32 to drive AC through a capacitor 88 and an electrically controlled, AC sensitive switch 30.

In FIG. 6, the safety circuit of FIG. 5 is integrated with the wakeup circuit of FIG. 1. As described above, there exists in this preferred embodiment a 5V output voltage regulator 102 and a 7V output voltage regulator 118 in parallel between the normally open contacts 35 and the logic control device 14. When the safety circuit control relay coil 30 is energized, the safety circuit normally open relay contact 31 is closed (providing 12V potential to the output drivers) and the safety circuit normally closed relay contact 33 is open (denying potential to the reset light 38). When the AC source fails, the capacitor 88 of the safety circuit acts as an open circuit, no current flows through the safety circuit AC relay coils 30, and the safety circuit normally closed relay contact 33 falls closed as the safety circuit normally open relay contact 31 falls open. When the safety circuit normally open relay contact 31 is open, power is denied to the output devices 18. As such, the microprocessor latch control relay 35 falls open and the CAN bus power feed relay 37 falls open, turning off the microprocessor and the networked accessories.

It will therefore be apparent to those of ordinary skill in the art upon being taught the present invention, described herein in relation to specific preferred embodiments, that the wakeup and safety functions may be achieved through alternative embodiments designed in accordance with other circuit elements. Regarding the wakeup circuit, the wakeup switch activates provision of a connection to provide a bridge between points of voltage potential difference to allow current to flow through a control relay or other electrically controlled switch to effect a secondary bridging between points of voltage potential difference to accommodate the provision of power to a network microprocessor or CCM that in turn powers network accessories. Regarding the safety circuit, an electrically controlled switch is provided in series with a selected circuit element that becomes an open circuit upon failure of an AC source that has output interruptible by failure of the microprocessor, loss of microprocessor signal, or loss of power. The electrically controlled switch terminates power to an operative circuit when the power across the switch is lost (due to power loss, or due to microprocessor or signal failure as described above).

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is:

1. A circuit for providing a wakeup function to a quiescent system of networked accessories, said circuit comprising:

a ground reference;

a voltage source;

a logic control device having a plurality of terminals, said logic control device being adapted to selectively communicate current from one or more of said terminals to one or more of said terminals;

a user-controllable actuator having a user-controllable actuator first status and a user-controllable actuator second status, said user-controllable actuator causing a closed-circuit to be formed between said ground reference and said voltage source when said user-controllable actuator is in said user-controllable actuator second status;

a first electrically controlled switch being disposed in series with the user controllable actuator between the ground reference and the voltage source, said first electrically controlled switch causing a closed circuit to be formed between said voltage source and said logic control device when said user-controllable actuator is disposed in said user-controllable actuator second position;

a second electrically controlled switch being disposed in series with the ground reference and the logic control device, said second electrically controlled switch causing a closed circuit to be formed between said voltage source and said logic control device when said logic control device allows current to pass through said second electrically controlled switch;

a third electrically controlled switch being disposed in series between said logic control device and said ground reference, said third electrically controlled switch causing a closed circuit to be formed between said voltage source and a system power line when said logic control device allows current to pass through said third electrically controlled switch.

2. The circuit of claim 1 wherein the user-controllable actuator comprises a double-pole, double-throw switch.

3. The circuit of claim 1 wherein the first electrically controlled switch comprises a normally open relay contact and a coil, said coil being disposed proximally to said normally open relay contact and said normally open relay contact being closeable in response to the generation of a magnetic field by the coil.

4. The circuit of claim 1 wherein the second electrically controlled switch comprises a normally open relay contact and a coil, said coil being disposed proximally to said normally open relay contact and said normally open relay contact being closeable in response to the generation of a magnetic field by the coil.

5. The circuit of claim 1 wherein the third electrically controlled switch comprises a normally open relay contact and a coil, said coil being disposed proximally to said normally open relay contact and said normally open relay contact being closeable in response to the generation of a magnetic field by the coil.

6. The circuit of claim 1 wherein the first electrically controlled switch comprises an electromechanical switch having a coil and a magnetically responsive, closeable, normally open contact relay, said coil being disposed in series with said user-controllable actuator between said ground reference and said voltage source, and said closeable, normally open contact relay being disposed in series between said logic control device and said voltage source.

7. The circuit of claim 1 wherein the first electrically controlled switch comprises a solid state device.

8. The circuit of claim 1 wherein the first electrically controlled switch comprises a field effect transistor.

9. The circuit of claim 1 wherein the second electrically controlled switch comprises an electromechanical switch having a coil and a magnetically responsive, closeable, normally open contact relay, said coil being disposed in series with said logic control device and said ground reference, and said closeable, normally open contact relay being disposed in series between said logic control device and said voltage source.

10. The circuit of claim 1 wherein the second electrically controlled switch comprises a solid-state device.

11. The circuit of claim 1 wherein the second electrically controlled switch comprises a field effect transistor.

12. The circuit of claim 1 wherein the third electrically controlled switch comprises an electromechanical switch having a coil and a magnetically responsive, closeable, normally open contact relay, said coil being disposed in series with said logic control device and said ground reference, and said closeable, normally open contact relay being disposed in series between said system power line and said voltage source.

13. The circuit of claim 1 wherein the third electrically controlled switch comprises a solid-state device.

14. The circuit of claim 1 wherein the third electrically controlled switch comprises a field effect transistor.

15. The circuit of claim 1 further comprising a voltage regulator disposed in series between said voltage source and said logic control device.

16. The circuit of claim 15 further comprising an output driver disposed in series between said logic control device and said second electrically controlled switch.

17. The circuit of claim 16 wherein the output driver is further disposed in series between said second electrically controlled switch and said voltage source at a junction, said junction being disposed, in series, between said voltage source and said logic control device so that the output driver may receive a reduced voltage signal via said logic control device and voltage regulator and so that the output driver may receive a higher voltage signal from said voltage source.

18. The circuit of claim 15 further comprising an output driver disposed in series between said logic control device and said third electrically controlled switch.

19. The circuit of claim 18 wherein the output driver is further disposed in series between said third electrically controlled switch and said voltage source at a junction, said junction being disposed, in series, between said voltage source and said logic control device so that the output driver may receive a reduced voltage signal via said logic control device and voltage regulator and receive a higher voltage signal from said voltage source.

20. The circuit of claim 1 wherein the voltage source comprises at least a first and a second battery.

21. The circuit of claim 20 wherein the first electrically controlled switch is disposed in series with said user-controllable switch and said first battery, and wherein said first electrically controlled switch provides a closed circuit between said second battery and said logic control device when a current flows between said first battery and said user controllable switch.

22. The circuit of claim 1 further comprising:

an AC source disposed to receive an intermittent DC from said logic control device, said AC source being adapted to generate an AC responsively thereto;

a capacitor and a electrically controlled switch, said electrically controlled switch comprising a control and a responsive element, said responsive element having a closed status and a normally open status, said capacitor and said control being disposed in series to pass said generated AC; and an output driver being disposed in series between said second electrically controlled switch and said logic control device and being disposed in series between said third electrically controlled switch and said logic control device;

said normally open control being disposed between said voltage source and said output driver.

* * * * *